US009032691B2

(12) United States Patent
Hawkins, III et al.

(10) Patent No.: US 9,032,691 B2
(45) Date of Patent: May 19, 2015

(54) SUPPORT STRUCTURE AND SYSTEM PROVIDING ELEMENT PROTECTION

(75) Inventors: Harold M. Hawkins, III, Atlanta, GA (US); Michael A. Lyle, Gainesville, GA (US); Timothy G. Osby, Atlanta, GA (US)

(73) Assignee: GDC Enterprises, Inc., Gainesville, GA (US)

( * ) Notice: Subject to any disclaimer, the term of this patent is extended or adjusted under 35 U.S.C. 154(b) by 0 days.

(21) Appl. No.: 13/596,392

(22) Filed: Aug. 28, 2012

(65) Prior Publication Data

US 2012/0317917 A1 Dec. 20, 2012

Related U.S. Application Data

(63) Continuation of application No. 12/369,965, filed on Feb. 12, 2009, now Pat. No. 8,276,344.

(60) Provisional application No. 61/028,181, filed on Feb. 12, 2008.

(51) Int. Cl.

| | |
|---|---|
| ***E04C 2/54*** | (2006.01) |
| ***E04F 11/16*** | (2006.01) |
| ***E04B 1/70*** | (2006.01) |
| ***E04B 2/00*** | (2006.01) |
| ***E04H 12/00*** | (2006.01) |
| ***E04B 5/02*** | (2006.01) |
| ***E04B 5/10*** | (2006.01) |
| *E04F 15/02* | (2006.01) |

(52) U.S. Cl.

CPC . *E04B 5/026* (2013.01); *E04B 5/10* (2013.01); *E04F 15/02* (2013.01)

(58) Field of Classification Search

CPC ..... E04F 15/02; E04B 5/026; E04B 1/003; E04B 5/10; E04B 5/43

USPC ..... 52/177, 302.1, 302.2, 302.3, 302.4, 52/302.6, 11, 588.1, 591.5, 783.1, 783.14, 52/783.15, 783.16, 489.1, 489.2, 650.3

See application file for complete search history.

(56) References Cited

U.S. PATENT DOCUMENTS

| | | | | |
|---|---|---|---|---|
| 3,046,852 | A * | 7/1962 | Graham | 52/581 |
| 3,062,338 | A * | 11/1962 | De Ridder et al. | 52/579 |
| 3,186,525 | A | 6/1965 | Gresham et al. | |
| 3,191,724 | A * | 6/1965 | De Ridder | 52/570 |

(Continued)

FOREIGN PATENT DOCUMENTS

| | | |
|---|---|---|
| GB | 2125841 A | 3/1984 |
| WO | 2006077272 A2 | 7/2006 |

*Primary Examiner* — Phi A

*Assistant Examiner* — Omar Hijaz

(74) *Attorney, Agent, or Firm* — Smith Risley Temple Santos LLC; Gregory Scott Smith

(57) ABSTRACT

A structural support system with a means for capturing and channeling elements originating from an exterior surface is disclosed. More specifically, the support system not only creates a dry area under a deck but is also a load bearing component of the deck. The support system is multifunctional in that it alleviates the need for traditional joist-dependent construction methods while simultaneously providing an efficient and aesthetically pleasing structure for maintaining a useful, dry area under the deck. Advantageously, embodiments are scalable in that the system comprises a repeatable series of interlocking components operable to be customized to any foreseeable deck footprint or load bearing application.

9 Claims, 17 Drawing Sheets

(56) References Cited

U.S. PATENT DOCUMENTS

| | | | | |
|---|---|---|---|---|
| 3,837,319 | A * | 9/1974 | Lehe | 119/529 |
| 3,946,529 | A * | 3/1976 | Chevaux | 150/105 |
| 3,995,593 | A | 12/1976 | Bowser | |
| 5,050,362 | A * | 9/1991 | Tal et al. | 52/588.1 |
| 5,613,339 | A * | 3/1997 | Pollock | 52/836 |
| 5,617,689 | A | 4/1997 | Beane | |
| 6,233,886 | B1 | 5/2001 | Andres | |
| 6,688,059 | B1 | 2/2004 | Walker | |
| 6,796,092 | B1 * | 9/2004 | Goebel | 52/302.1 |
| 7,131,161 | B2 * | 11/2006 | Lee | 14/73 |
| 7,793,470 | B1 | 9/2010 | Mathiesen et al. | |
| 7,846,524 | B2 * | 12/2010 | Baglietto | 428/54 |
| 2004/0020136 | A1 * | 2/2004 | Hauck | 52/11 |
| 2006/0096187 | A1 * | 5/2006 | Perkowski et al. | 52/177 |
| 2006/0288651 | A1 | 12/2006 | Zeng et al. | |
| 2007/0277453 | A1 | 12/2007 | Trageser et al. | |
| 2008/0276557 | A1 | 11/2008 | Rapaz | |
| 2009/0266018 | A1 * | 10/2009 | Stockton | 52/302.3 |

* cited by examiner

SUPPORT STRUCTURE AND SYSTEM PROVIDING ELEMENT PROTECTION

CROSS-REFERENCE TO RELATED APPLICATIONS

This application was filed under 35 USC 120 and 37 CFR 1.53(*b*) as a continuation of the United States Application for Patent entitled SUPPORT STRUCTURE AND SYSTEM PROVIDING ELEMENT PROTECTION that was filed on Feb. 12, 2009 and assigned Ser. No. 12/369,965 and issued on Oct. 2, 2012 as U.S. Pat. No. 8,276,344, which application claimed the benefit of the filing date of the United States Provisional Application for Patent filed on Feb. 12, 2008 and assigned Ser. No. 61/028,181, both applications of which are hereby incorporated by reference.

BACKGROUND

The present disclosure is related to support structures and namely, support structures that provide impedance against the migration of elements and that alleviates support requirements for underlying support frames.

At one time, folks didn't require a whole lot of living space. Houses were small, functional, and most likely only on a single level. If a homeowner wanted or needed more living space, he could just "bump out" his dwelling and daisy chain his living quarters until it resembled an above ground version of a rabbit warren.

Times have changed. In many real estate markets, it is pretty near impossible to even find a single level property. With a demand for larger, more spacious homes combining with higher and higher land prices, it often just doesn't make sense to build a sprawling single level home—even where land is relatively flat. Not surprisingly, home builders have eschewed single level designs in favor of building multi-story dwellings.

With the growing demand for multi-story homes, came the demand for outdoor living space accessible from the upper stories of those homes. A drive through just about any housing development younger than 20 years will inevitably reveal at least one example of just such a phenomenon. It is common to see decks 10 to 20 feet off the ground with access to the house through a doorway leading from a kitchen, den, master bedroom or some other living space found in the home's upper story. Further, because the decks are so high off the ground, it is another common feature that the space underneath the deck functions as a service area, parking space, or ground level outdoor living space of one kind or another.

Because the space beneath an upper story deck is so often used by a home owner in some way or another, a demand has emerged for systems or products that can provide a measure of protection from the elements that drip from the deck above. For example, because decks are intentionally built with a slight grade to shed water, rain falling on an upper story deck surface will find its way between decking boards and onto to the space below. As a result of exposure to the water dripping from above, the area beneath a deck may be limited in its usefulness.

There are many products on the market designed to alleviate, or at least mitigate, the exposure of an area beneath a deck to water raining down from the deck surface above. While each system currently on the market has its unique design elements, a common aspect among them is their mutual exclusivity from the load bearing components of a typically constructed deck. More specifically, current products designed to protect the area beneath a deck are usually of a retrofit design intended to be installed on a plane defined by the bottom of existing wooden deck joists. Therefore, current systems are not designed to be structural, load bearing members of the deck. Rather, current deck systems designed to protect the area beneath a deck simply close in the space occupied by the existing wooden joists with the purpose of capturing any water or debris falling through the decking surface.

While moderately effective, the current systems outlined above have common shortfalls. First, the requirement of being retrofitted to existing joists means that current systems represent an added component offering limited or no structural benefit. Second, because a large space encompassing the joists is captured, wooden joists are exposed to any moisture not drained from the system. Third, the complexities of the current systems usually necessitate installation by trained professionals in order to guarantee water ingress resistant integrity.

Therefore, what is needed in the art is a structural deck drainage system that can replace traditional joists in outdoor deck construction and is also operable to protect the area beneath the deck from any elements originating from the deck surface.

BRIEF SUMMARY

Generally, embodiments presented in this disclosure are directed towards a structural outdoor deck joist system with a means for capturing and channeling water originating from the deck surface. More specifically, the disclosed embodiments include a support structure or system that define a water resistant surface for receiving decking material while reducing the amount of traditional supporting structures (i.e., beams and joists) and thus, the disclosed system not only provide a means for a dry area under an outdoor deck but also serves as a load bearing component of the deck. Moreover, disclosed embodiments are multifunctional in that they alleviate the need for traditional joist-dependent construction methods while simultaneously providing an efficient means for maintaining a useful, dry area under the deck.

Advantageously, some of the disclosed embodiments are scalable in that the system comprises a repeatable series of interlocking components operable to be customized to any foreseeable deck footprint or load bearing application. Generally, to employ these embodiments, a deck frame without traditional joists, or with a reduced number and density of traditional joists, can be constructed and supported. Next, the desired combination of system components are interlocked and secured to the top of the deck frame, providing a structurally sound platform for receiving a decking material. Once received, the decking material completes a structurally sound, load bearing geometry. Further, the decking material may be of a design inherently communicable with other system components or, in some embodiments, the decking material may be of a traditional material, such as a wood or composite board, and secured over the top of the present system via traditional fasteners, i.e. screws.

Once installed, the support system distributes any applied load to the deck frame structure. Further, any water or other elements draining from the deck surface are captured within the support system and channeled to the exterior of the deck footprint, thereby providing a dry, usable space beneath the deck. Notably, the support system is operable to be secured to the deck frame via traditional fasteners without jeopardizing the water resistant aspect of the support system. Various embodiments of the support system are designed or constructed such that fasteners can be driven through interlocking portions of the system components in areas inherently protected from water ingress.

As mentioned prior, the support system is comprised of a series of interlocking components. Not all components, however, are required in all embodiments. Depending on the deck footprint, the choice of decking material, the design load for the deck, and other factors, the proper combination of components for a given embodiment can vary. Further, it should be appreciated that variations in component profiles and materials of construction are anticipated for differing applications and will be known to those skilled in the art. Specific designs of system components, although considered individually as novel, therefore, should not be considered as a limitation but rather are provided as a means of example.

Some embodiments of the support system are operable to receive a traditional decking material such as, but not limited to, wood, vinyl, or composite boards. Yet other embodiments of the support system include system components that function as a finished deck surface. Still other embodiments may include components to function as stairs, railings, work surfaces, flashing, storage or the like. Importantly, the inclusion, or exclusion, of various components, or features thereof, although considered to be novel, are not absolutely necessary in all combinations in all embodiments and should, therefore, not be construed as limitations.

The various embodiments of the support system provide a scalable means for distributing a deck load to a supporting deck frame while simultaneously capturing and channeling elements away from an area defined beneath the deck footprint. The aforementioned advantages, as well as other aspects, features and embodiments of the support system are presented in greater detail in the following description.

DETAILED DESCRIPTION OF VARIOUS EMBODIMENTS

Figure 1:
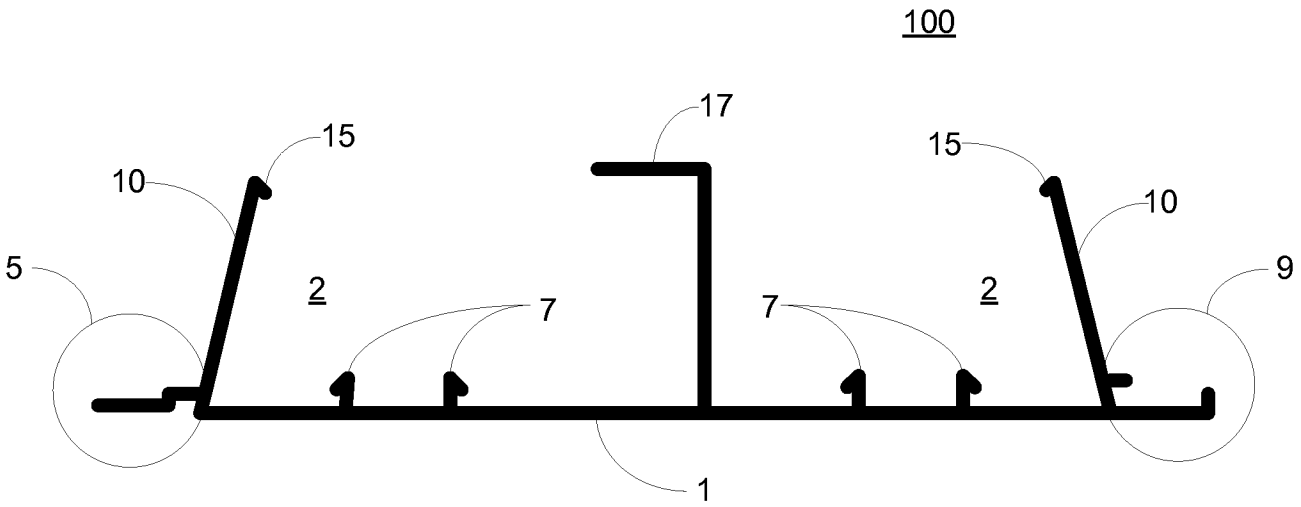
FIG. 1 is a sectional profile view of a main support component used in some embodiments of the support system, incorporating both a flange edge and a receiver edge.

Various embodiments of the support system are directed towards a structural outdoor deck support system with structures that are operable for capturing and channeling water originating from the deck surface. More specifically, the support system not only provides a means for a dry area under an outdoor deck but is also a load bearing component of the deck and thus, can eliminate or reduce other support requirements, such as joists, cross-beams, etc. Moreover, the support system is multifunctional in that it alleviates the need for traditional joist-dependent construction methods while simultaneously providing an efficient structure for maintaining a useful, dry area under the deck. Also, compared to decks constructed with traditional joist-dependent methods, embodiments of the support system provide increased density of decking load points, advantageously decreasing deck surface flex.

Advantageously, embodiments of the support system are scalable in that the system comprises a repeatable series of interlocking components operable to be customized to any foreseeable deck footprint or load bearing application. Generally, to employ an embodiment of the support structure, a deck frame without traditional joists, or a reduced number of traditional joists, is constructed and supported. Next, the desired combination of system components are interlocked and secured to the top of the deck frame, providing a structurally sound platform for receiving a decking material. If the decking material itself is not a component of the system, some embodiments accommodate the installation of traditional decking material with traditional fasteners over the top of, or on top of, the support system.

Once installed, embodiments of the support system distribute applied loads on the support system to the deck frame structure. Further, any water or other elements draining from the deck surface are captured within the support system and channeled to the exterior of the deck footprint, thereby providing a substantially dry, usable space beneath the deck. Notably, embodiments of the support system provide for a means of securing the system to the deck frame via traditional fasteners without jeopardizing the water resistant aspect of the system. Moreover, embodiments of the support system are designed such that fasteners can be driven through the interlocking portions of the system components in areas inherently protected from element ingress.

As mentioned prior, the support system is comprised of a series of interlocking components. Not all components, however, are required in all embodiments. Depending on the deck footprint, the choice of decking material, the design load for the deck, and other factors, the proper combination of components for a given embodiment, construction or implementation can vary. Further, it should be appreciated that variations in component profiles and materials of construction are anticipated for differing applications and will be known to those skilled in the art. Specific designs of system components, therefore, should not be considered as a limitation but rather are provided as non-limiting examples.

The individual components that comprise various embodiments or constructions of the various components of the support structure may be novel in, and of, themselves. Even so, the presence or absence of any particular component is not a limiting factor when considering the scope of the disclosure. Further, the chosen method of manufacture or material of construction for system components will be known to those skilled in the art and, while possibly novel in its own right, should also not limit the scope of the disclosure. Therefore, for illustrative and a non-limiting examples, one known method of manufacture for the system components described hereafter is extrusion of a suitable composite material through a die.

Exemplary system components are designed to span 8 feet without support from an underlying deck frame. Even so, it is anticipated that choices concerning profiles and materials of construction could increase the feasible unsupported span length of a given component under a given load. Generally, while components vary in profile and features, the foundational components used in most embodiments comprise a channel feature and are operable to interlock with adjacent components. Once interlocked and secured to a suitable underlying deck support frame, the support system comprising the components is operable to distribute a load force to the underlying deck frame as well as prevent, or substantially mitigate, the area defined underneath the deck from exposure to elements originating from the deck.

Some embodiments of the support structure are operable to receive a traditional decking material such as, but not limited to, wood or composite boards. In an exemplary system configuration operable to receive traditional decking material, various foundational, channel-like components are connected in series by way of tongue and groove connection features located on either side of each component and running lengthwise along the plane of the component base. As mentioned prior, each of these foundational components in the exemplary system embodiment features an overall channel-like profile having a relatively flat base with channel walls angling upward from the base, and may even include a bias toward the component center. As a result, when the foundational components are interlocked via the tongue and groove connection features running lengthwise along the plane of the bases, the angled walls of adjacent components are biased away from each other and combine to form the approximate shape of a "V." Thus, when a decking material, or other system component, is fixed along the top plane defined by the foundational components of an installed system, the angled channel walls combine with the decking material, or other system component, to make a structurally sound, load bearing truss geometry.

Further, the foundational components of an exemplary support system operable to receive a traditional decking material may also contain other features in addition to the above-described angled channel walls and connection aspects. For instance, some foundational components may also feature mounting rails that run lengthwise within the space defined by the overall channel, operable to receive other system components. In addition, an inverted "L" feature, located roughly in the center of the component, rising out of the channel from the base, may also be featured.

As mentioned prior, regardless of the specific features embodied in each, the foundational components can be interlocked in a side by side manner. Further, those foundational components fitted with mounting rails can receive anchor clips, an optional system component that is an inverted channel, which are operable to provide a flat surface roughly on plane with the uppermost point of the foundational component with which it is mated. Even further, a joint channel cover component may be included to connect the channel walls of adjacently interlocked foundational components, thereby providing a water ingress resistant chamber to protect the connection point of said interlocked components. Optionally, the joint channel cover described immediately prior may be integral to a foundational component such that when adjacent foundational components are interlocked, the integral channel cover, which extends roughly horizontally from the top of one of the foundational components, is operable to communicate with the adjacent foundational component and provide a water ingress resistant chamber to protect the interlocked connection point.

Once the support system is configured according to the desired application or construction, traditional decking material may be fastened across the top plane of the support system via screws, nails, or the like. The fasteners can be driven through the decking material and into the top of any "L" features or anchor clips. It should be appreciated that to retain the water ingress resistant integrity of the system, fasteners should not be driven through joint channel covers as doing so may provide a flow path for water through the foundational component connections and into the space defined below the deck.

Yet other embodiments include system components that function as a finished deck surface. In one such embodiment, a combination of foundational components, as previously described relative to a system operable to receive traditional decking, can be used. Unlike a system embodiment with traditional decking material, however, a system embodiment with a deck surface component may not require joint channel covers in order to maintain the system's water ingress resistant integrity. Rather, the deck surface component may be operable to connect the channel walls of adjacently interlocked foundational components, thereby providing a water ingress resistant chamber to protect the connection point of said interlocked components. Further, in some embodiments, the deck surface components define planes that run lengthwise with the foundational channel components and create seams at the point of juxtaposition such that any water finding a path through the seams is captured within the foundational components and channeled away from the space beneath the deck.

Still other embodiments may include components to function as stairs, railing, work surfaces, flashing, storage or the like. The inclusion, or exclusion, of various components, or features thereof, are provided as non-limiting examples that will be appreciated by those skilled in the art and should not, therefore, be construed as a limitation on the disclosure. Further, materials of construction for various components of various embodiments of the support system may vary without limiting the scope of the invention. It should be appreciated that choices of materials for various components, and the subsequent performance characteristics attributed to those choices, will be known to those skilled in the specific art.

Turning now to the figures, where like labels represent like elements throughout the drawings, various aspects, features and embodiments of the support structure are presented in more detail. The examples as set forth in the drawings and detailed description are provided by way of explanation and are not meant as limitations. The various embodiments of the support system thus include any modifications and variations of the following examples as come within the scope of the appended claims and their equivalents.

FIG. 1 is a sectional profile view of a main support component 100 used in some embodiments of the support system, incorporating both a flange edge 5 and a receiver edge 9. The main support component 100 is a foundational component that may be incorporated into typical embodiments of the support system. The overall profile of the main support component 100 is one of a channel 2 comprising a substantially flat base 1 with two angled walls 10 biased toward the center of the component. It should be appreciated that while the exemplary component profile depicted in FIG. 1 is shown with angled walls 10, embodiments may feature walls in a substantially vertical orientation relative to the base 1. The top edge of the angled walls is shown as including a tab 15, or some other means, operable to mechanically mate with other system components such as a joint channel cover.

Running lengthwise on opposing sides of the channel 2, roughly in plane with the base 1 and on the outside of the space defined by the angled walls 10, is a flange edge 5 and a receiver edge 9. The flange edge 5 of the main support component 100 is operable to be received by a receiver edge 9 of an adjacent main support component for the purpose of interlocking the components. It should be noted that the interlocking mechanism depicted herein is provided by way of example only and, although it is considered novel in and of itself, should not be considered as a limiting aspect of the main support component 100. More specifically, the interlocking feature described is one of a "tongue and groove" design, but other interlocking arrangements will be known to those skilled in the art.

Roughly centered within the channel 2 of the component is an inverted "L" feature 17 providing a flat surface communicable with the underside of any decking and operable to provide support and receive traditional fasteners such as, but not limited to, screws, rivets, glue, adhesive, welds or nails. Also featured within the component channel 2 may be a series of anchor clip mounting rails 7 fitted with tabs, or some other structure, operable to mechanically mate with an anchor clip component that will be described subsequently.

Figure 2:
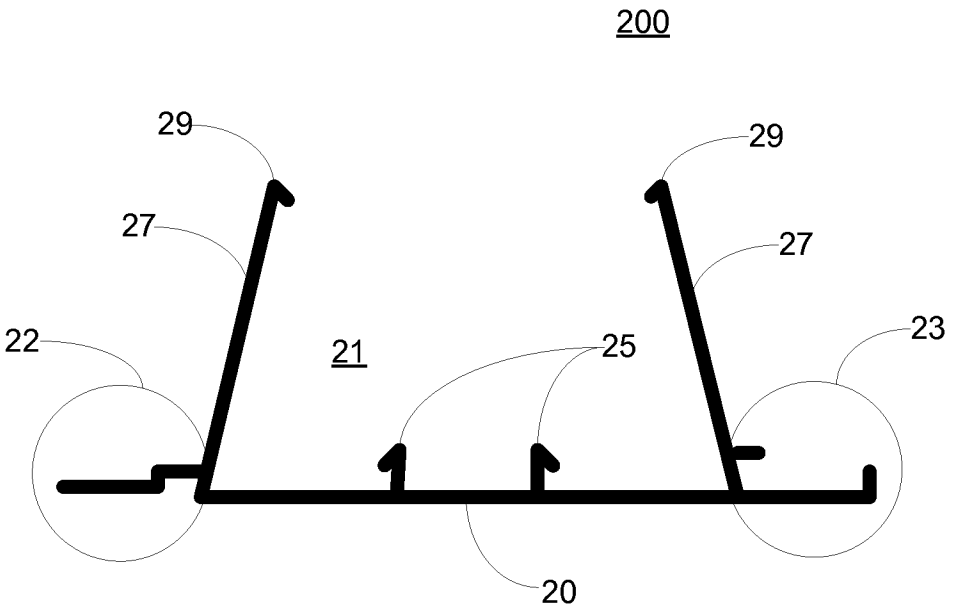
FIG. 2 is a sectional profile view of a narrow support component used in some embodiments of the support system, incorporating both a flange edge and a receiver edge.

FIG. 2 is a sectional profile view of a narrow support component 200 used in some embodiments of the support structure, incorporating both a flange edge 22 and a receiver edge 23. The narrow support component 200 is a foundational component that may be incorporated into typical embodiments, constructions or implementations of the support structure and is similar in its function and profile to the main support component 100 previously described. Unlike the main support component 100, however, the narrow support component 200 is not as wide and may not comprise an inverted "L" feature. Even so, the narrow support component comprises an overall channel profile 21 with a substantially flat base 20 and angled channel walls 27 biased toward its center having tabs at the distal edges 29, or some other structure, operable to mechanically mate with a joint channel cover component. Like a main support component 100, it should be appreciated that while the exemplary component profile depicted in FIG. 2 is shown with angled walls 27, embodiments may feature walls in a substantially vertical orientation relative to the base 20. Also, similar to a main support component 100, the narrow support component 200 may feature a set of anchor clip mounting rails 25 fitted with tabs, or some other structure, operable to mechanically mate with an anchor clip component.

Figure 3:
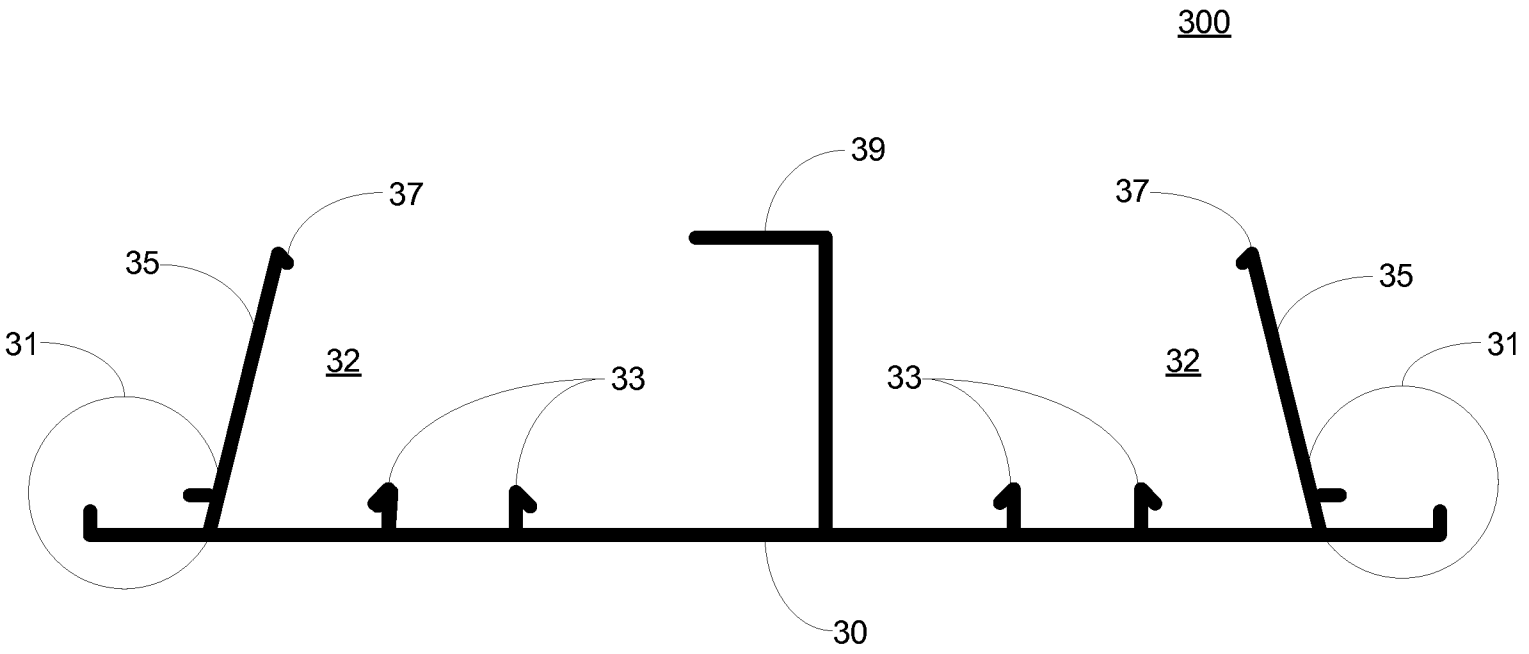
FIG. 3 is a sectional profile view of a double support component used in some embodiments of the support system, incorporating two receiver edges.

FIG. 3 is a sectional profile view of a double support component used in some embodiments of the support system, incorporating two receiver edges. Turning to FIG. 3, the profile of the double support foundational system component 300 used in some embodiments, constructions or implementations of the support system is depicted. In general, the double support component 300, and variations thereof, is substantially the same as that described relative to the main support component 100 except for the edge profiles used for interlocking with adjacent foundational components. More specifically, as opposed to the main support component 100 which features a receiver edge and a flange edge, a double support component 300 features identical interlocking edge profiles 31 on both sides of the component. For exemplary purposes, FIG. 3 depicts a double joist component featuring receiver edge 31 profiles, but it is anticipated that other edge configurations will be known to those skilled in the art. One purpose of featuring identical interlocking aspects along both edges of the component is to provide a means by which the joist direction can be alternated within an installation of an embodiment.

The overall profile of the double joist component is one of a channel 32 comprising a substantially flat base 30 with two angled walls 35 biased toward the center of the component. It should be appreciated that while the exemplary component profile depicted in FIG. 3 is shown with angled walls 35, embodiments may feature walls in a substantially vertical orientation relative to the base 30. The top edge of the angled walls comprise a tab 37, or some other structure, operable to mechanically mate with other system components such as a joint channel cover.

Running lengthwise on either side of the channel 32, roughly in plane with the base 30 and on the outside of the space defined by the angled walls 35, are identical edge profiles 31 operable to interlock with a mating edge profile from an adjacent foundational component. It should be noted that the interlocking mechanism depicted herein, although considered novel in and of itself, is provided by way of example only and should not be considered as a limiting aspect required in all embodiments of the support structure. More specifically, the interlocking feature described is one of a "tongue and groove" design, but other interlocking arrangements will be known to those skilled in the art.

Roughly centered within the channel 32 of the double support component 300 is an inverted "L" feature 39 providing a flat surface communicable with the underside of any decking and operable to provide support and receive traditional fasteners such as, but not limited to, screws, rivets, glue, adhesive, welds or nails. Also featured within the component channel 32 may be a series of anchor clip mounting rails 33 fitted with tabs, or some other structure, operable to mechanically mate with an anchor clip component that will be described subsequently.

Figure 4:
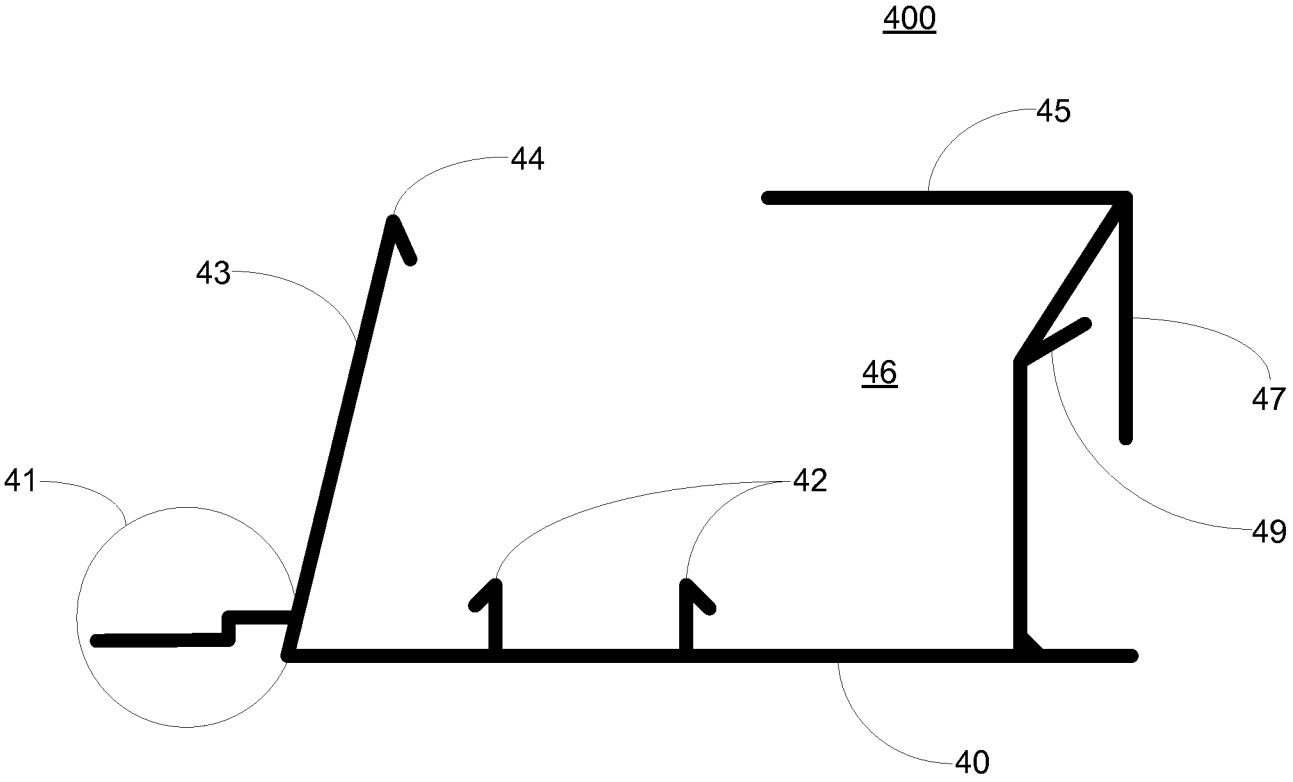
FIG. 4 is a sectional profile view of an end support component used in some embodiments of the support system, incorporating both a flange edge and a finished edge.

FIG. 4 depicts a sectional profile of an end support component 400 used in some embodiments of the support system, incorporating both a flange edge 41 and a finished edge 47. The end support component 400 is a foundational component that may be incorporated into typical embodiments of the support structure and is similar in its function and profile to the narrow support component 200 previously described. Similar to the narrow support component 200, the end support component 400 is not as wide as a main support component 100 and may not comprise an inverted "L" feature. Further, like the narrow support component 200, the end support component does comprise an overall channel 46 profile with a substantially flat base 40. Also similar to a narrow support component 200, an end support component 400 may feature a set of anchor clip mounting rails 42 fitted with tabs, or some other structure, operable to mechanically mate with an anchor clip component.

The end support component 400 differs from the narrow support component 200 previously described, however, in that the end support component 400 features only a single angled channel wall 43 biased toward its center having a tab at its distal edge 44, or some other structure, operable to mechanically mate with a joint channel cover component. It should be appreciated that while the exemplary component profile depicted in FIG. 4 is shown with an angled wall 43, embodiments may feature a wall in a substantially vertical orientation relative to the base 40. On the opposite side of the end support component 400 from the channel wall 43 is a wall functional as a finished edge 47 for the support system and having a substantially flat feature 45 providing a surface communicable with the underside of any decking and operable to provide support and receive traditional fasteners such as, but not limited to, screws, rivets, glue, adhesive, welds or nails. Also featured in some embodiments of the end support component 400 is a means for mechanically receiving a flashing component 49.

Figure 5A:
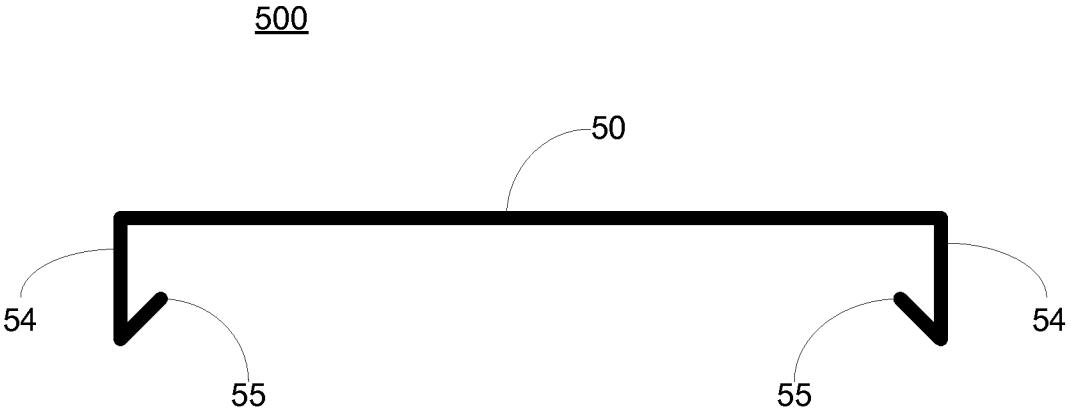
FIG. 5A is a sectional profile view of a joint channel cover component used in some embodiments of the support system.

FIG. 5A is a sectional profile view of a joint channel cover component used in some embodiments of the support system. Turning to FIG. 5A, the profile of a joint channel cover component 500 used in some embodiments, constructions or implementations of the support system is depicted. As previously described, the joint channel cover 500 is operable to mechanically mate with the channel walls (i.e., 10 in FIG. 1, 27 in FIG. 2, 35 in FIGS. 3 and 43 in FIG. 4) of adjacently interlocked foundational components, thereby completing the triangular truss geometry and providing a water ingress resistant chamber to protect the connection point of said interlocked components. The particular embodiment of a joint channel cover 500 depicted in FIG. 5A features simply a substantially flat surface 50 operable to communicate with the underside of any decking. Extending downward from the top surface 50 and running lengthwise with the component are two short walls 54 with tabs 55, or some other structure, operable to mechanically mate with angled channel walls from adjacent foundational components. Notably, to provide a level of protection to the space defined beneath a deck from water and other elements originating from the deck surface, the joint channel cover can be utilized for receiving traditional decking. Further, and advantageously, embodiments of the support system with water ingress resistant joint channels provide an inherent conduit feature useful to house wire and other electrical system components.

Figure 5B:
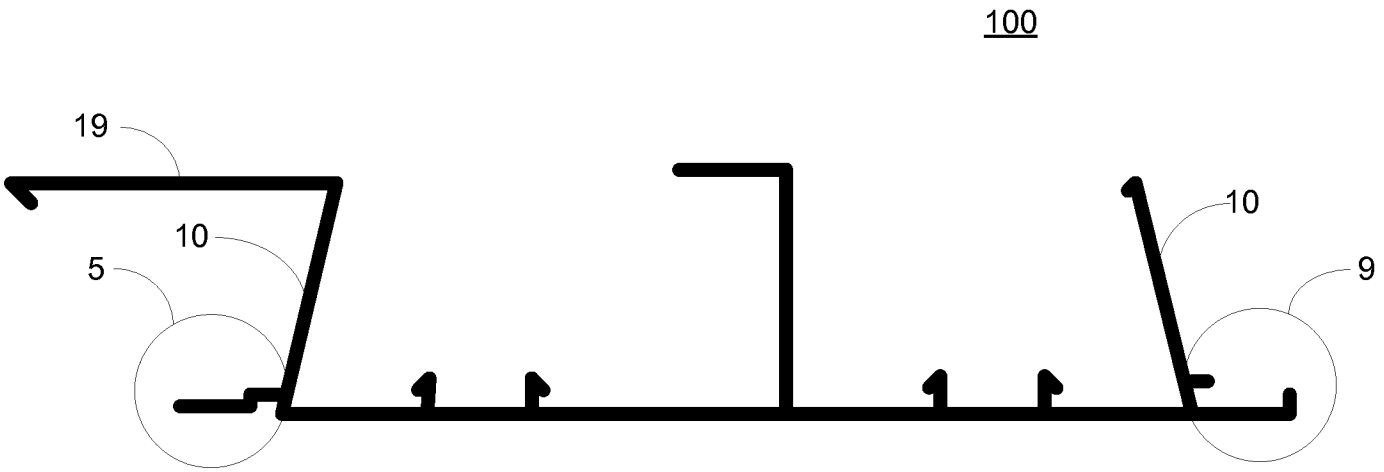
FIG. 5B is a sectional profile view of a main support component used in some embodiments of the support system, incorporating a flange edge, a receiver edge, and an integral joint channel cover.

FIG. 5B is a sectional profile view of a main support component 100 used in some embodiments of the support system, incorporating a flange edge 5, a receiver edge 9, and an integral joint channel cover 19. While FIG. 5B depicts an embodiment of a main support component 100 which features an optional integral joint channel cover 19, it should be understood that such a feature may be included in any of the foundational components described herein, or variations thereof. FIG. 5B, therefore, is offered as a non-limiting example of how a component profile may vary without limiting the scope of the disclosure.

In an exemplary system incorporating a foundational component with an integral joint channel cover 19 feature, joint channel covers 500, such as those described in FIG. 5, would not be required. The integral joint channel cover 19, extending roughly horizontally from the top of a foundational component wall 10, is operable to communicate with the channel wall of an adjacent, interlocked foundational component and function substantially as that described relative to FIG. 5A.

Figure 6:
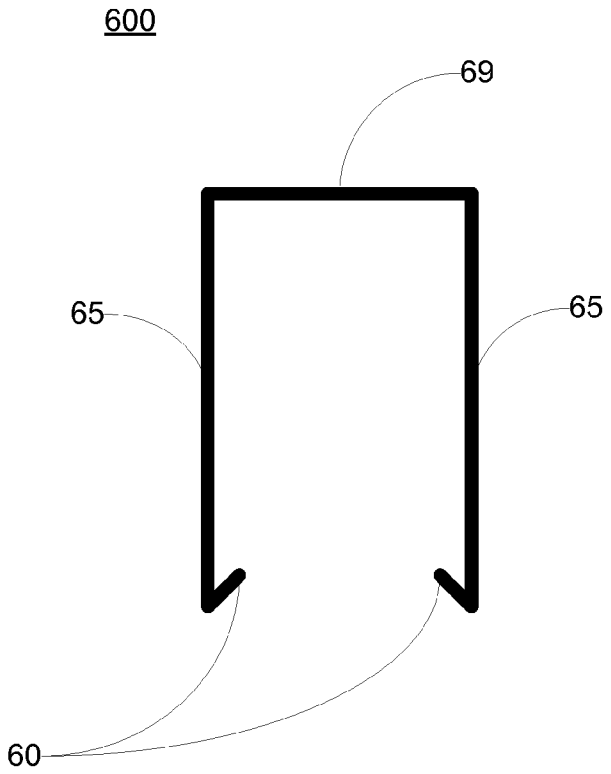
FIG. 6 is a sectional profile view of an anchor clip component used in some embodiments of the support system.

FIG. 6 is a sectional profile view of an anchor clip component used in some embodiments of the support system. In FIG. 6, the profile of an anchor clip component 600 used in some embodiments, constructions or implementations of the support system is depicted. As previously described, some foundational components feature anchor clip mounting rails operable to receive an anchor clip component 600. In some embodiments of the support system, the purpose of the anchor clip component 600 is to provide additional structural support to the decking surface and/or receive fasteners driven through traditional decking.

The anchor clip component is generally comprised of a substantially flat surface 69 operable to communicate with the underside of any decking. Extending downward from the top surface 69 and running lengthwise with the component are two walls 65 with tabs 60, or some other structure, operable to mechanically mate with anchor clip mounting rails set within the channel of a foundational component.

Figure 7:
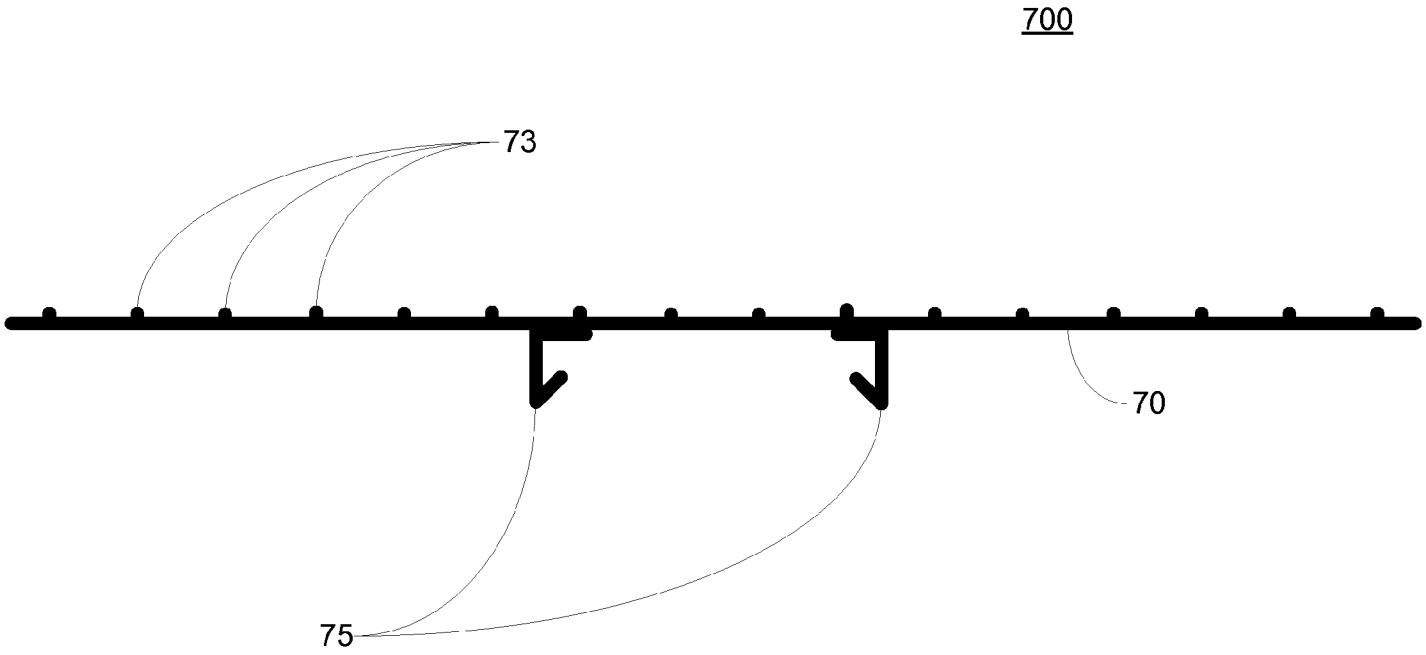
FIG. 7 is a sectional profile view of a snap on deck board component used in some embodiments of the support system.

FIG. 7 depicts the profile of a snap on deck board component used in some embodiments of the support structure. As described prior, some embodiments do not require the use of traditional decking materials. For such embodiments, a deck board component such as that depicted in FIG. 7 may be included in the system.

The exemplary deck board component 700 in FIG. 7 is operable to "snap-on" and mechanically mate with the tops of angled channel walls originating from foundational components (i.e., 10 in FIG. 1, 27 in FIG. 2, 37 in FIGS. 3 and 43 in FIG. 4). The deck board surface 70 is functional as the overall deck surface and may feature patterns, textures, or other means of treatment known to those skilled in the art of deck surfaces. The specific embodiment depicted in FIG. 7 features a deck board surface 70 with a series of ridges 73. The deck board is operable to mate with underlying foundational components via tabs 75, or some other mechanical means.

Notably, once a deck board component is in communication with the angled channel walls originating from foundational components, triangular truss geometry useful to distribute loads to the deck framing structure is completed. Even so, the particular truss geometry may vary with, and within, embodiments of the support structure and should not be construed as limiting the scope therein. Further, the communication of a deck board component with the angled channel walls from foundational components may operate to seal a joint channel space within the system from the ingress of water or other elements.

Figure 8:
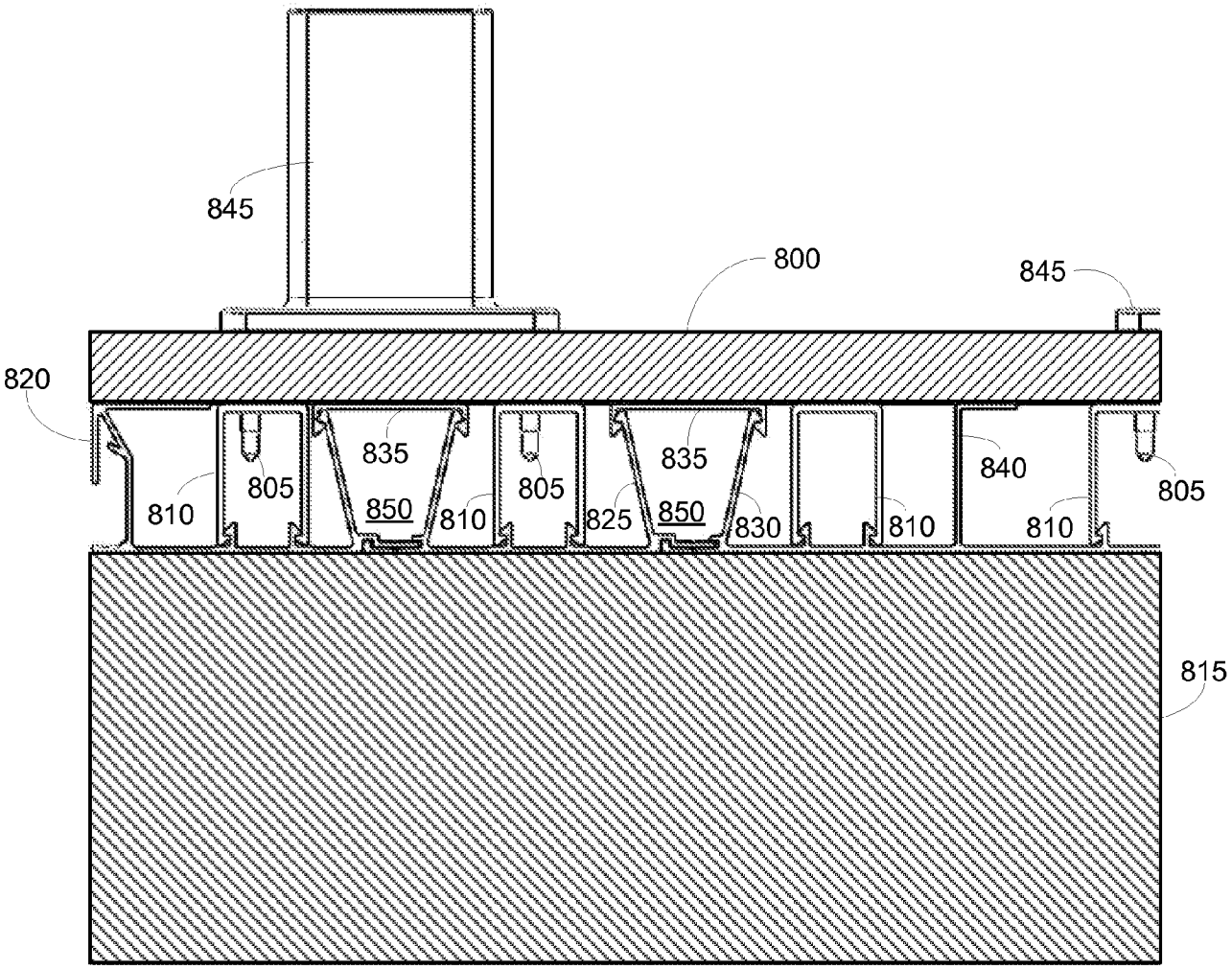
FIG. 8 is a cross-sectional view of an exemplary installation incorporating various elements of the support system and that is operable to receive a traditional decking material.

FIG. 8 is a cross-sectional view of an exemplary installation incorporating various elements of the support system and that is operable to receive a traditional decking material. The particular embodiment or configuration shown is one operable to receive traditional decking material 800 such as wood or composite planks. As described prior, adjacent foundational components are interlocked in series and secured on top of a deck frame 815.

In FIG. 8, beginning with the left most foundational component and moving right, an end support component 820 is shown interlocked with a narrow support component 825.

The narrow support component 825, in turn, is shown interlocked with a main support component 830 that is only partially depicted. Mounted to the anchor clip mounting rails featured at the base of each of the foundational joist components is a series of anchor clips 810 operable to provide additional structural support to the decking surface and/or receive fasteners 805 driven through traditional decking 800 or decking accessories such as a post column 845. Also shown as part of the main support structure 830 is an inverted "L" feature 840 communicable to the underside of the decking 800.

As previously addressed, a desirable aspect of some embodiments of the support system is the ability to provide for an area beneath the deck that is protected from water or other elements originating from the deck surface. In the embodiment depicted in FIG. 8, joint channel covers 835 are shown mechanically mated to the angled walls from adjacent foundational components, the result being the creation of a protected, water resistant chamber 850 that houses each of the interlocked joints. Advantageously, any water or other element originating from the deck surface 800 cannot enter the chambers 850 that house the joints but, rather, is captured within all the other channels defined by the foundational component profiles. Further, the joint channel covers 835 provide additional surfaces for mounting of the deck surface 800.

Figure 9:
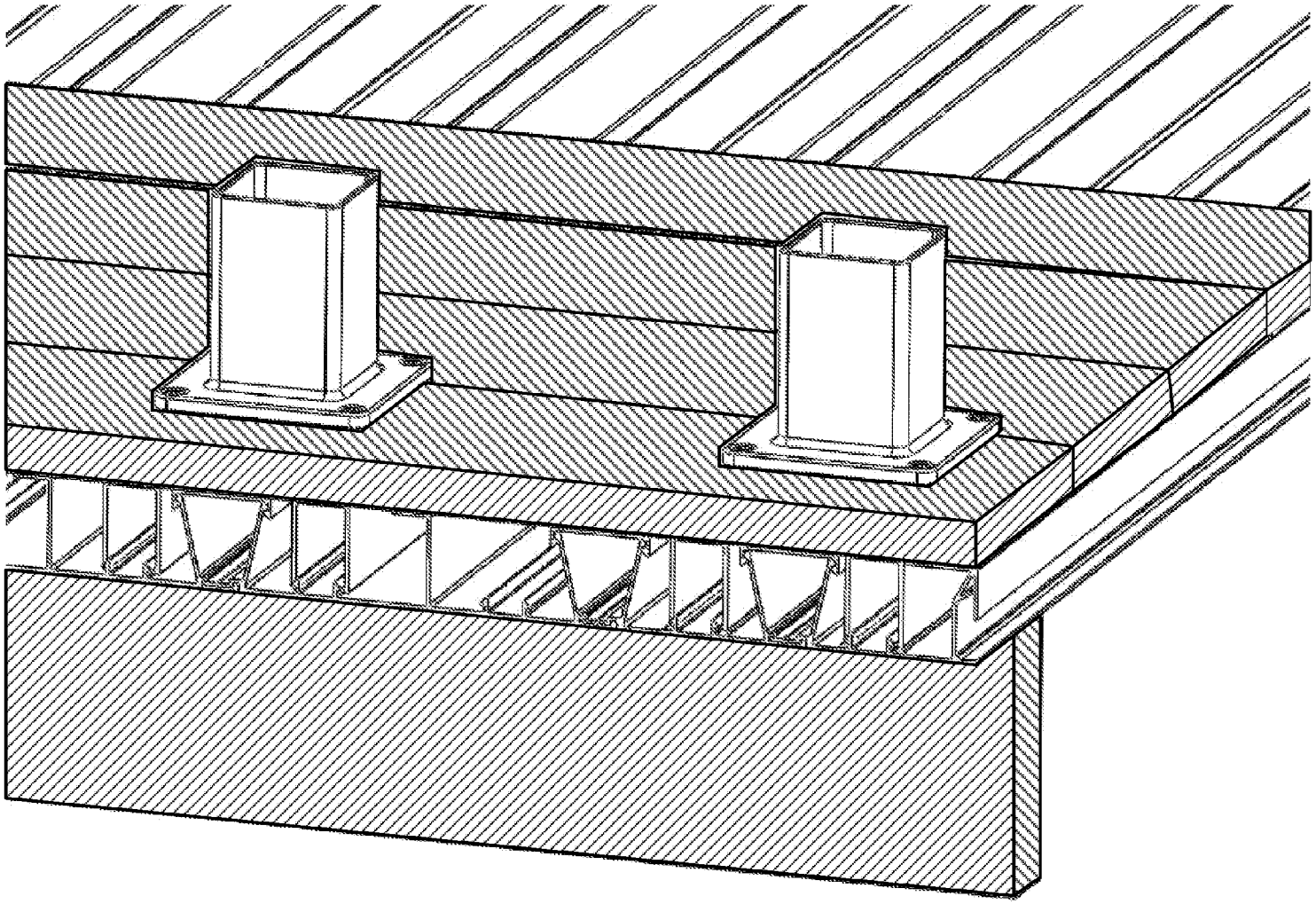
FIG. 9 is a perspective cross-sectional view of another exemplary installation incorporating various elements of the support system and that is operable to receive a traditional decking material.

FIG. 9 is a perspective cross-sectional view of another exemplary installation incorporating various elements of the support system and that is operable to receive a traditional decking material. Further, FIG. 9 is a perspective, cutaway view of a similar embodiment as that described relative to FIG. 8 and is offered for clarifying purposes. In the FIG. 9 depiction, no anchor clips are shown installed.

Figure 10:
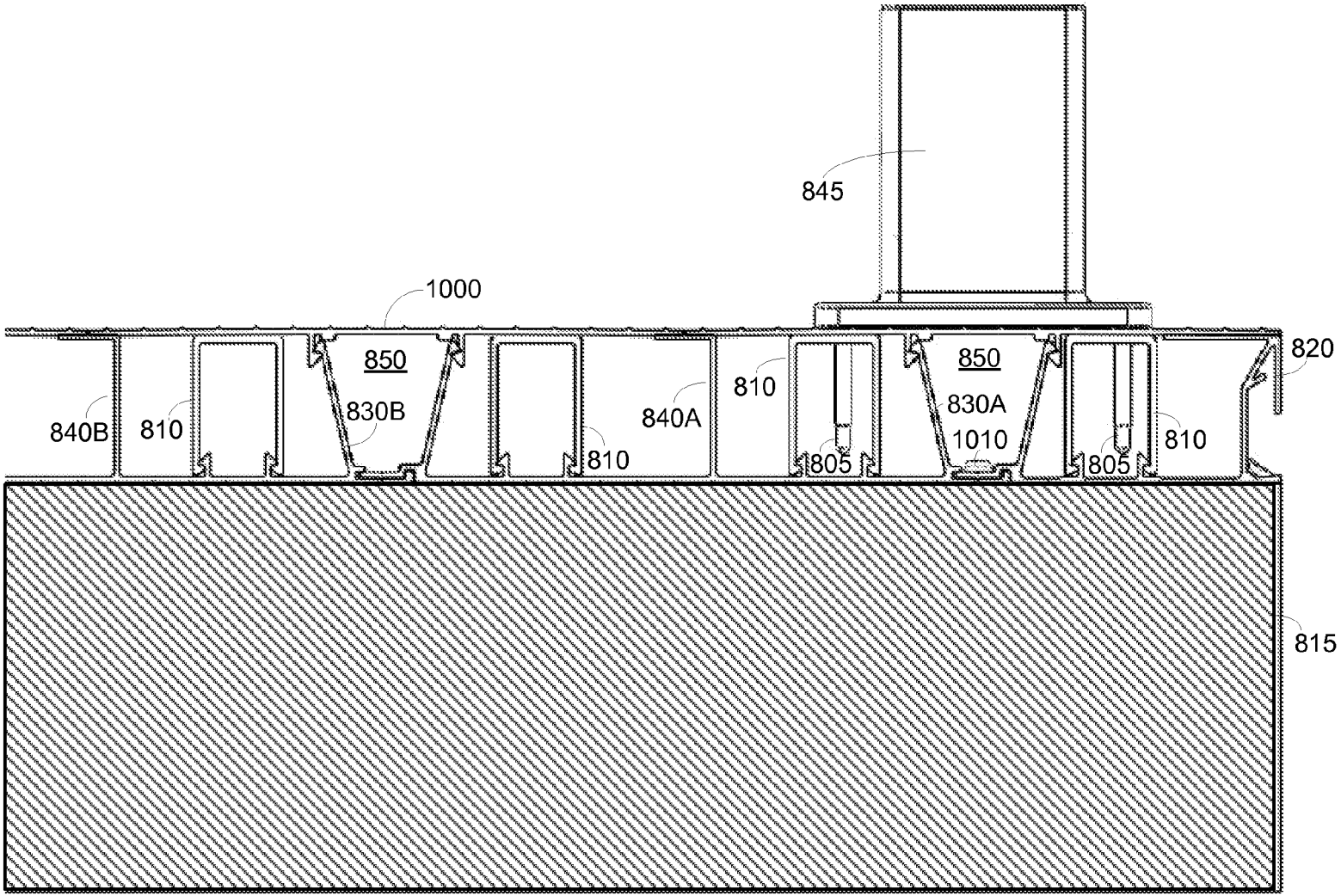
FIG. 10 is a cross-sectional view of another exemplary installation incorporating various elements of the support system and that includes a system component operable as a decking material.

FIG. 10 is a partial cross-sectional view of an installed embodiment of the support system. The particular embodiment shown is one operable to receive a deck board component 1000 operable to provide a decking surface. As described prior relative to FIG. 8, adjacent foundational components are interlocked in series and secured on top of a deck frame 815. Fasteners 1010, such as screws, nails or other fasteners can be driven through the interlocked joints and into the deck frame 815 in order to secure the overall joist system to said deck frame 815.

Similar to that described in FIG. 8, beginning with the right most foundational component and moving left, an end support component 820 is shown interlocked with a main support component 830. The main support component 830A, in turn, is shown interlocked with an adjacent main support component 830B that is only partially depicted. Both main support components 830A and 830B feature an inverted "L" feature 840A and 840B operable to provide support to the deck board components 1000.

Mounted to the anchor clip mounting rail aspects featured at the base of each of the foundational support components is a series of anchor clips 810 operable to provide additional structural support to the decking surface and/or receive fasteners 805 that have been driven through the deck board components 1000 for the purpose of securing decking accessories such as a post column 845.

Once again, a desirable aspect of some embodiments of the support system is the ability to provide for an area beneath the deck that is protected from water or other elements originating from the deck surface. In the embodiment depicted in FIG. 10, joint channel covers 835 are not required (see FIG. 8). Rather, the deck board components 1000 are operable to mechanically mate with the angled walls from adjacent foundational components, the result being the creation of a protected, water ingress resistant chamber 850 that houses each of the interlocked joints. Advantageously, any water or other element originating from the deck surface 1000 cannot enter the chambers 850 that house the joints but, rather, is captured within all the other channels defined by the foundational component profiles. Also, the communication of the deck board components 1000 with the angled channel walls operates to complete triangular truss geometry, useful for translating loads from the deck surface to the underlying deck frame 815.

Figure 11:
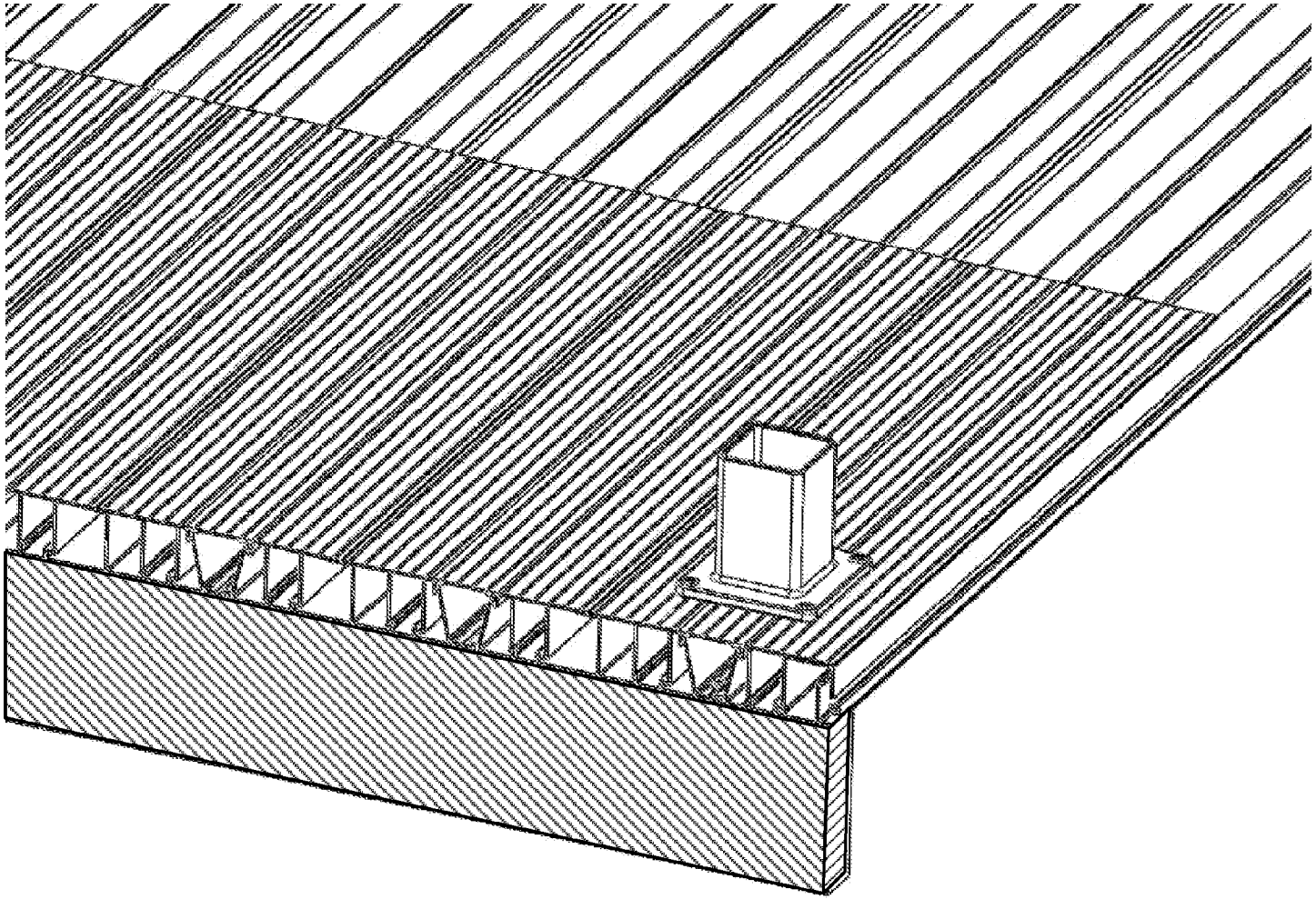
FIG. 11 is a perspective cross-sectional view of yet another exemplary installation incorporating various elements of the support system and that includes a system component operable as a decking material.

FIG. 11 is a cut-away, perspective view of the embodiment described relative to FIG. 10 and is offered herein for clarifying purposes.

Exemplary system embodiments, component combinations, and individual component profiles for one family of the support system have been described herein above. As stated prior, specific component profiles and component combinations will vary with system embodiments or applications and, therefore, the variations offered within this disclosure are meant as non-limiting examples of the scope of the present support system. As a further example of embodiment variations, a different family of component profiles is offered hereafter and should be construed as further evidence that the individual component profiles, or combinations of components, may be novel individually without limiting the scope of the overall support system.

Turning now to FIGS. 12 through 16, another exemplary embodiment of the present support system and its individual components is depicted and described. Unlike the embodiments described prior, the embodiment described hereafter does not require the use of a joint channel cover component in order to maintain water ingress resistance relative to the component joint channels. Similar to the previously described embodiments, however, the embodiment described hereafter may contain other features such as anchor support rails, anchor support components, varying component connection profiles, or the like. Advantageously, the embodiment described hereafter comprises only three foundational components, each load bearing and communicable to an adjacent foundational component. Like the embodiments described prior, the embodiment described hereafter should not be interpreted as a limiting example of the disclosed support system but, rather, should be seen as indicative of the broad range of embodiments included in the present scope.

Figure 12:
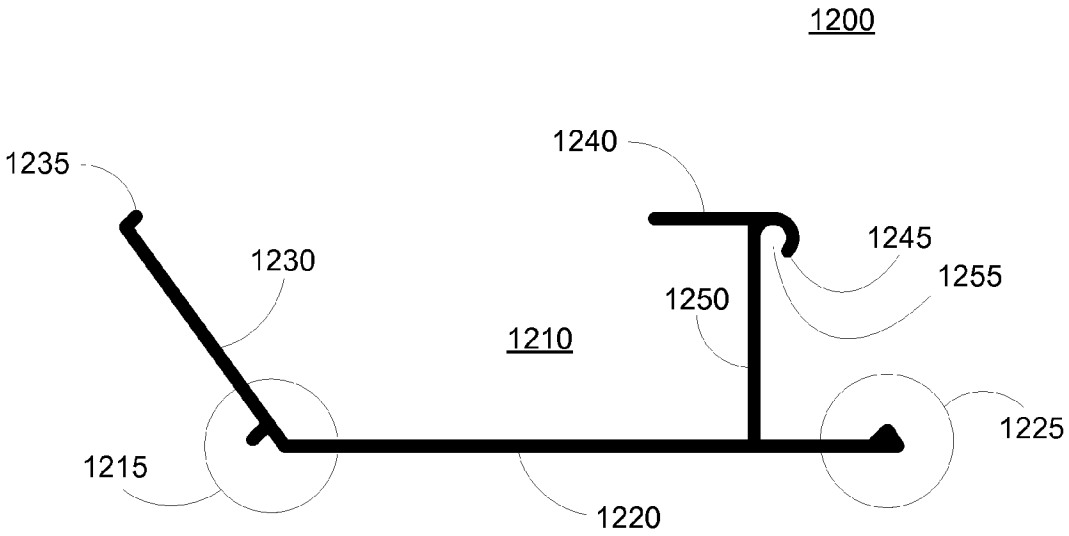
FIG. 12 is a sectional profile view of a main support component used in some embodiments of the support system.

FIG. 12 is a sectional profile view of a main support component 1200 used in some embodiments of the support system. The component depicted in FIG. 12 is a foundational component that is operable, when mated with an adjacent foundational component, to distribute an applied load to an underlying support structure. The component incorporates both a tongue edge 1225 and a groove edge 1215. The overall profile of the main support component 1200 is one of a channel 1210 comprising a substantially flat base 1220 with a single angled wall 1230 on one side biased away from the center of the component and a wall 1250 on the opposite side of the channel 1210 that rises substantially perpendicular from said base 1220. It should be appreciated that while the exemplary component profile depicted in FIG. 12 is shown with an angled wall 1230 and a vertical wall 1250, embodiments may feature walls oriented at various angles relative to the base 1220.

The top edge of the angled wall 1230 is shown as including a tab 1235, or some other means, operable to mechanically mate with adjacent system components. The top edge of the vertical wall 1250 features a cap that includes a support element that is a substantially flat surface 1240 that extends substantially parallel to the channel base 1220 toward the center of the component such that an inverted "L" shape is formed by the vertical wall 1250 and the flat surface 1240. The substantially flat surface 1240 is useful to receive fasteners, of virtually any type known to those skilled in the art, such that a decking surface or other decking accessories can be secured to an assembled support system. Also featured at the top of vertical channel wall 1250, on the side opposite the channel 1210, is a connection feature 1245 which enables a mechanical connection to be made with the angled wall tab or flange from an adjacent foundational component. In the illustrated embodiment, the cap is substantially "J" shapped with the connection feature 1245 and the vertical wall 1250 defining a cavity 1255 that receives the tab or flange of the angled wall from an adjacent foundational component. However, it will be appreciated that the connector 1245 and the flat surface 1240 may also have other configurations, such as creating a mirrored "L" shape as a non-limiting example. Other configurations are also anticipated. For instance, the connector 1245 may be a straight protrusion and the connector and surface 1240 may be formed to create an obtuse angle while still allowing the connector and the vertical wall 1250 to define a cavity.

Running lengthwise on opposing sides of the channel 1210, roughly in plane with the base 1220 and on the outside of the space defined by the angled wall 1230 and the vertical wall 1250, is a groove edge 1215 and a tongue edge 1225. The tongue edge 1225 of the main support component 1200 is operable to be received by a groove edge of an adjacent foundational component for the purpose of interlocking the components. Notably, in the particular support system embodiment currently being described, the groove edge and angled wall tab of one foundational component simultaneously communicate with the tongue edge and connection feature of an adjacent foundational component. In doing so, adjacent foundational components are securely interlocked and operable to distribute an applied load to an underlying support structure via triangular truss geometry. It should be noted that the interlocking mechanism depicted herein is provided by way of example only and, although it is considered novel in and of itself, should not be considered as a limiting aspect of the main support component 1200. More specifically, the interlocking feature described is one of a general "tongue and groove" design, but other interlocking arrangements will be known to those skilled in the art.

Figure 13:
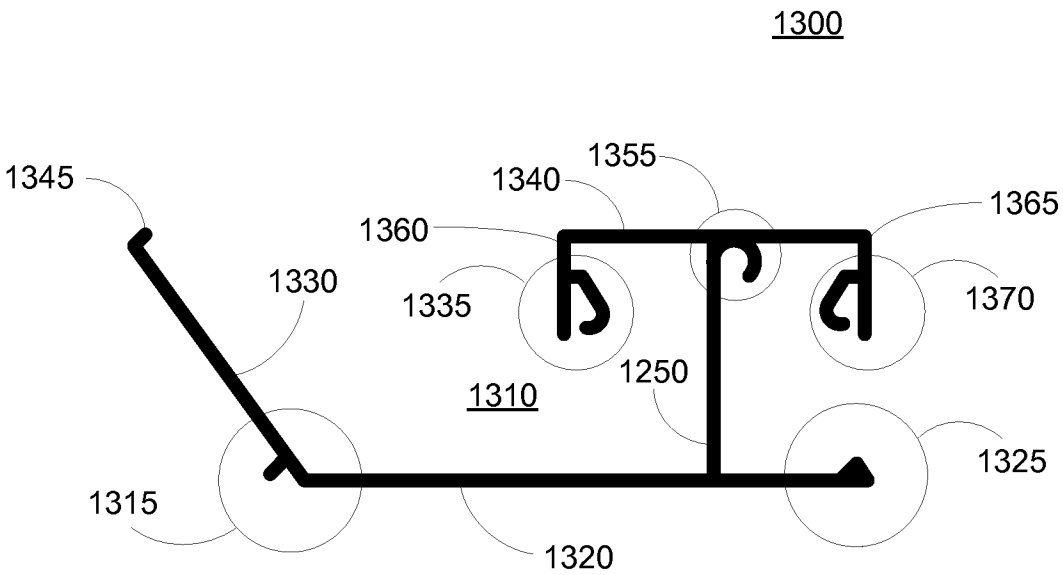
FIG. 13 is a sectional profile view of a multi-purpose support component used in some embodiments of the support system, incorporating both a finish edge and a channel wall.

FIG. 13 is a sectional profile view of a multi-purpose support component used in some embodiments of the support system, incorporating both a finish edge 1360 and an angled channel wall 1330. The multi-purpose support component is a foundational component that is a variation of the main support component described immediately prior. Different from the main support component described immediately prior, however, the multi-purpose support component features finish edges 1360, 1365 that provide an aesthetically pleasing profile if visible. Aesthetically pleasing is defined as a finished look wherein when viewing the product from the side, a flat surface is visible and that blocks the view of the connectors used to fasten decking material. Further, on the interior of each finish edge 1360, 1365 is a means 1335, 1370 by which flashing may be securely communicated with the component.

The component depicted in FIG. 13 is a foundational component that is operable, when mated with an adjacent foundational component, to distribute an applied load to an underlying support structure. The component incorporates both a tongue edge 1325 and a groove edge 1315. The overall profile of the multi-purpose support component 1300 is one of a channel 1310 comprising a substantially flat base 1320 with a single angled wall 1330 on one side biased away from the center of the component and a wall 1350 on the opposite side of the channel 1310 that rises substantially perpendicular from said base 1320. It should be appreciated that while the exemplary component profile depicted in FIG. 13 is shown with an angled wall 1330 and a vertical wall 1350, embodiments may feature walls oriented at various angles relative to the base 1320.

The top edge of the angled wall 1330 is shown as including a tab 1345, or some other means, operable to mechanically mate with adjacent system components. The top edge of the vertical wall 1350 features a substantially flat surface 1340 that extends parallel to the channel base 1320 toward the center of the component such that an inverted "L" shape is formed. The substantially flat surface 1340 is useful to receive fasteners, of virtually any type known to those skilled in the art, such that a decking surface or other decking accessories can be secured to an assembled support system. Also featured at the top of vertical channel wall 1350, on the side opposite the channel 1310, is a connection feature 1355 which enables a mechanical connection to be made with the angled wall tab from an adjacent foundational component.

Running lengthwise on opposing sides of the channel 1310, roughly in plane with the base 1320 and on the outside of the space defined by the angled wall 1330 and the vertical wall 1350, is a groove edge 1315 and a tongue edge 1325. The tongue edge 1325 of the multi-purpose support component 1300 is operable to be received by a groove edge of an adjacent foundational support component for the purpose of interlocking the components.

Figure 14:
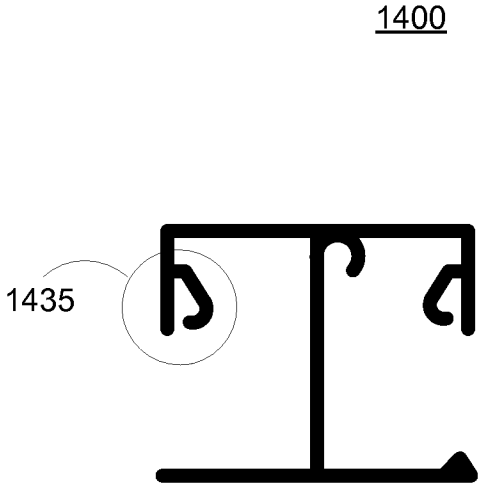
FIG. 14 is a sectional profile view of a ripped multi-purpose support component used in some embodiments of the support system, exposing a left-hand finish edge.

FIG. 14 is a sectional profile view of a ripped multi-purpose support component 1400 used in some embodiments of the support system, exposing a left-hand finish edge 1335. By removing the angled channel wall 1330 from the multi-purpose component 1300 described prior, a ripped multi-purpose support component 1400 is created. The purpose of doing so is to expose a left-handed finish edge 1335 so that it can be visible in an installed system. Other features, benefits, and operations previously described relative to the multi-purpose foundational component remain.

Figure 15:
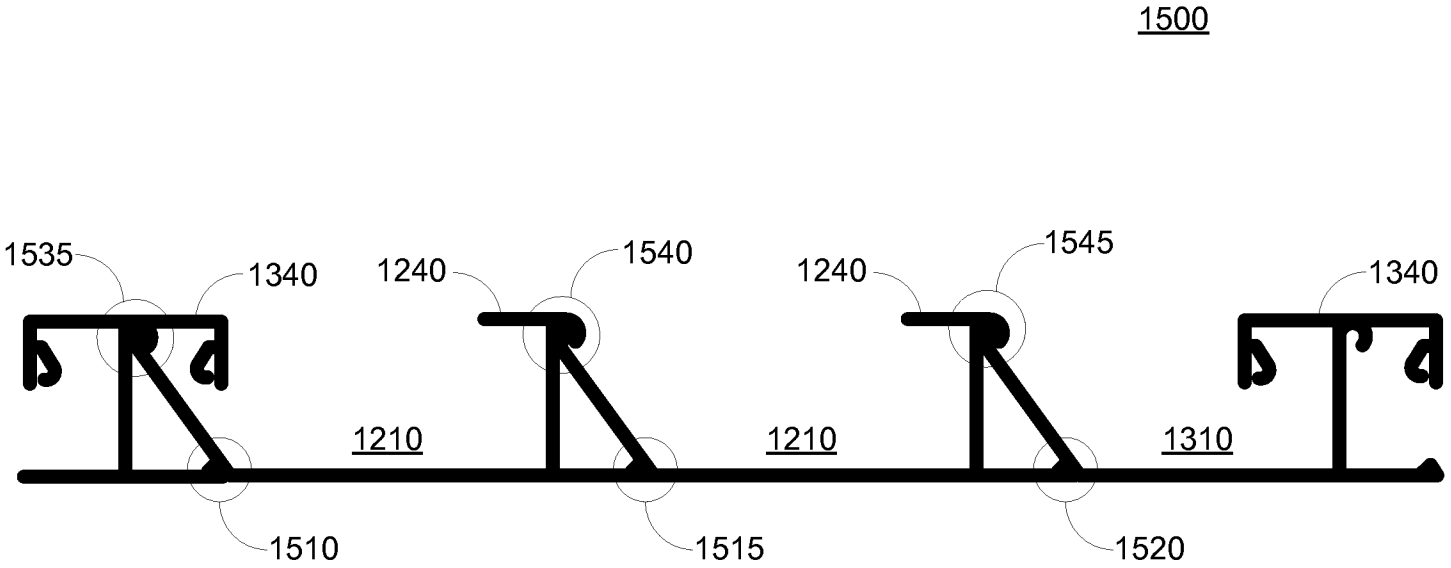
FIG. 15 is a cross-sectional view of another exemplary installation incorporating various elements of the support system and that is operable to receive a traditional decking material.

FIG. 15 is a cross-sectional view of an exemplary assembled support system 1500 utilizing the foundational components described relative to FIGS. 12 through 14. The particular embodiment shown is operable to receive a traditional decking material.

Moving left to right, shown is a ripped multi-purpose support component 1400 communicating with a main support component 1200 which, in turn, is communicating with another main support component 1200 which, in turn, is communicating with a multi-purpose support component 1300. Notably, the assembled system maintains the channel features 1210, 1310 of the foundational components such that water originating from a deck surface is captured and channeled away to the exterior of the space defined by the system. Advantageously, the channeling away of such water creates a useful, dry space beneath the system that is at least somewhat protected from elements.

The substantially flat surfaces 1240, 1340 are positioned in a plane relative to one another such that a decking surface may be affixed. Further, the groove edges and angled wall tabs of each foundational component simultaneously communicate with the tongue edges and connection features of adjacent foundational components. In doing so, adjacent foundational components are securely interlocked 1510, 1515, 1520, 1535, 1540, 1545, and operable to distribute an applied load to an underlying support structure via triangular truss geometry.

Figure 16:
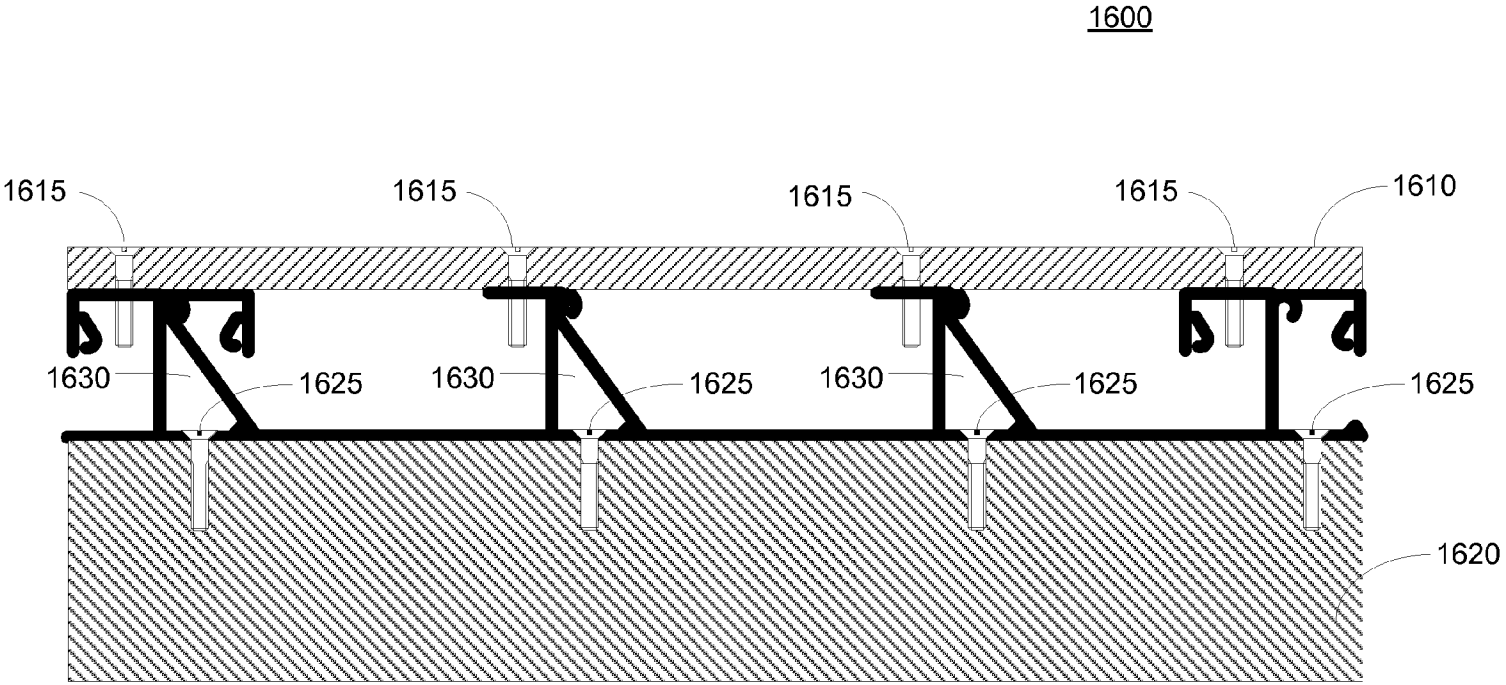
FIG. 16 is a cross-sectional view of the exemplary installation shown in FIG. 15 which incorporates various elements of the support system and depicts the exemplary system communicating with a traditional deck surface and a support frame.

FIG. 16 is a cross-sectional view of the same exemplary support system 1600 shown in FIG. 15 and depicts the exemplary system communicating with a traditional deck surface 1610 and a support frame 1620. The assembled support system is operable to distribute an applied load from the deck surface 1610 to the underlying support frame 1620. As described prior, each of the foundational components features a substantially flat area useful to receive fasteners 1615 for securing a deck surface 1610. Also, the interlocking of the foundational components, as described prior, serves to create a water ingress resistance space 1630 that prevents, or substantially mitigates, exposure of the support system fasteners 1625 to the elements. Advantageously, the water ingress resistant spaces further the performance of the support system to provide a useful, dry area in the space defined beneath the support system as the installed fasteners 1625 are not exposed to water. Rather, any water or other element originating from the deck surface is caught in the channels 1210, 1310 as described prior.

It should be appreciated that various modifications to the above-described embodiments may also be employed. For instance, the walls of the support structures have been described as angling in a particular orientation. It should also be appreciated that other orientations may also be utilized or, the walls could be substantially parallel to each other and substantially perpendicular to the bases. In addition, rather than walls, a tube or arched structure could be included in the support components. The arched structure could provide an upper surface for supporting a decking element and/or receiving a fastener element. Similarly, the joint cover and anchor clips have been described as having an upper surface that is flat. However, it will be appreciated that these elements may also be configured as convex or concave arches, corrugated structures, or structures that from a profile appear sinusoidal, saw-toothed, square-waved, etc. Such modifications could provide additional support while still maintaining the water ingress resistant and mounting characteristics. More specifically, it will be appreciated that in most embodiments, it is desirable for the joint cover to not be pierced by a fastener. To help avoid an accidental piercing, the joint cover can be concave, or even follow the contour of the gap in the joint area such that if a fastener is driven through overlying decking, it will not penetrate the joint cover. Similarly, the joint cover may be constructed as including a tube, such as a round tube, square tube, triangular shaped tube, semicircle, etc. so that a fastener can penetrate an upper surface of the tube but the lower surface of the tube would still provide water resistant protection to the underlying joint.

The illustrated components are typically constructed from extruded aluminum but, it will be appreciated that other materials may also be employed. For instance, the support system could be used simply as a means for creating a water tight roof. In such an embodiment, the components could be fabricated out of plastic, vinyl or other light weight material. Similarly, for industrial applications, the components can be made from a more structurally sound material such as iron or steel.

Although embodiments have been described in the context of decking systems, as previously mentioned and reiterated, the illustrated components may also be used as interior or exterior walls. Advantageously, application of the support system in these embodiments can provide additional structural support and integrity while eliminating or reducing the needs for other supporting structures. In addition, it should be appreciated that channels or gaps can be formed in the walls between the components, either in alignment or staggered, to allow for the placement of plumbing, wiring or other times to traverse through the structure.

The support system has been described using detailed descriptions of embodiments thereof. The embodiments are provided by way of example and are not intended to be limiting on the overall scope or supported embodiments of the support system. The described embodiments comprise different features, not all of which are required in all embodiments. Some embodiments of the support system utilize only some of the features or possible combinations of the features. Variations of embodiments of the support system that are described and embodiments comprising different combinations of features noted in the described embodiments will occur to persons of the art.

To be clear, it will be appreciated by persons skilled in the art that the disclosure encompasses a support system but, the present invention is not limited by what has been particularly shown and described explicitly within this disclosure. It should be understood that the particular order or combination of interlocked foundational components is not a limiting factor but rather has been provided as non-limiting examples. Further, while the specific profiles of various system components may be novel in and of themselves, variations in component designs should not be limiting. Rather the scope of the invention is defined by the claims that follow.

What is claimed is:

1. An interlocked support system configured to mechanically receive a series of decking components, the interlocked support system comprising:

a first interlocking foundational component comprising a substantially flat base that defines an open space between a first side structure and a second side structure that are connected only by the flat base, wherein:

the first side structure comprises a first wall positioned at an angle less than ninety degrees relative to the flat base, wherein a first lower connection mechanism is positioned at the lower end of the first wall and a first upper connection mechanism is positioned at the upper end of the first wall; and the second side structure comprises a second wall positioned substantially perpendicular to the flat base, a substantially flat surface at the top of the second wall, and a lower floor, wherein a second lower connection mechanism is positioned at an end of the lower floor and a second upper connection mechanism is positioned at the upper end of the second wall; and a second interlocking foundational component comprising a substantially flat base that defines an open space between a first side structure and a second side structure that are connected only by the flat base, wherein:

the first side structure comprises a first wall positioned at an angle less than ninety degrees relative to the flat base, wherein a first lower connection mechanism is positioned at the lower end of the first wall and a first upper connection mechanism is positioned at the upper end of the first wall; and the second side structure comprises a second wall positioned substantially perpendicular to the flat base, a substantially flat surface at the top of the second wall, and a lower floor, wherein a second lower connection mechanism is positioned at an end of the lower floor and a second upper connection mechanism is positioned at the upper end of the second wall;

wherein the first upper and lower connection mechanisms of the first interlocking foundational component are interlocked, respectively, with the second upper and lower connection mechanisms of the second interlocking foundational component such that the first side of the first interlocking foundational component and the second side of the second interlocking foundational component cooperate to define an enclosed space.

2. The interlocked support system of claim 1, wherein the first lower connection mechanisms comprise a groove and the second lower connection mechanisms comprise a tongue.

3. The interlocked support system of claim 1, wherein the first upper connection mechanisms comprise a tongue and the second upper connection mechanisms comprise a groove.

4. The interlocked support system of claim 1, wherein the lower floors are operable to receive fasteners for fixedly attaching a foundational component to a support structure.

5. The interlocked support system of claim 4, further comprising a support structure fixedly attached to a foundational component via fasteners received by the support structure through the lower floor of the foundational component.

6. The interlocked support system of claim 1, further comprising:

a third interlocking foundational component, wherein the third interlocking foundational component comprises:

a first side comprising a first wall, wherein a first lower connection mechanism is positioned at the lower end of the first wall and a first upper connection mechanism is positioned at the upper end of the first wall; and a second side comprising a second wall, a substantially flat surface substantially perpendicular to the second wall, and a finishing edge substantially parallel to the second wall, wherein:

the substantially flat surface is operable to receive a fastener that fixedly attaches the third interlocking foundational component to a decking component; and the finishing edge serves to block a view of the fastener received by the substantially flat surface.

7. The interlocked support system of claim 6, wherein the third interlocking foundational component further comprises a flashing attachment mechanism configured to receive a flashing component.

8. The interlocked support system of claim 7, further comprising a flashing component.

9. The interlocked support system of claim 1, wherein the enclosed space has a triangular cross-section.

* * * * *